US005207126A

United States Patent [19]

Schaben

[11] Patent Number: 5,207,126

[45] Date of Patent: May 4, 1993

[54] ROOF SHAKE REMOVAL TOOL

[76] Inventor: Bernard J. Schaben, 7795 Greenleaf Dr., Omaha, Nebr. 68128

[21] Appl. No.: 808,466

[22] Filed: Dec. 16, 1991

[51] Int. Cl.[5] ..... E04D 15/00

[52] U.S. Cl. ..... 81/45; 7/166; 254/25

[58] Field of Search ..... 81/45, 46; 254/25, 131; 7/166

[56] References Cited

U.S. PATENT DOCUMENTS

D. 137,738 4/1944 Bradley ..... 81/45 X 3,134,574 5/1964 Reuterfors ..... 254/25

*Primary Examiner*—James G. Smith

*Attorney, Agent, or Firm*—Leon Gilden

[57] ABSTRACT

A generally "L" shaped tool of rigid construction includes a first planar leg plate orthogonally mounted to a second arcuate leg plate, wherein the first leg plate includes a first leg plate bifurcated free end defining a first leg plate notch, and wherein the second leg plate includes a convex leg plate surface oriented in confronting relationship relative to the first leg plate free end. The second leg plate includes a second leg plate free end formed with a first medial notch and respective second and third lateral notches positioned adjacent the free end relative to opposing first and second sides of the second leg plate to provide for multiple access to various nails and the like in removal of shingles and shakes without damage to underlying felt. A modification of the invention includes a support mount for the tool of the invention.

1 Claim, 4 Drawing Sheets

ROOF SHAKE REMOVAL TOOL

BACKGROUND OF THE INVENTION

1. Field of the Invention

The field of invention relates to shingle removal tool structure, and more particularly pertains to a new and improved roof shake removal tool wherein the same is addressed to the removal of shingles and shake without damage to an underlying felt.

2. Description of the Prior Art

Various tools are utilized in the prior art for the removal of shingles prior to a re-roofing procedure. Such apparatus is exemplified in U.S. Pat. No. 4,798,366 to Pearson, et al., wherein a nail puller is arranged to grasp nails between spaced plier-like jaws utilizing a foot member mounted forwardly of the jaws as a leverage fulcrum.

U.S. Pat. No. 4,042,210 to Felman sets forth a leverage pry bar formed with a downward direction fulcrum leg.

U.S. Pat. No. 3,680,834 to Holloway sets forth a pry bar nail puller wherein a hook shaped one end is integrally mounted to a forward second end of the organization.

As such, it may be appreciated that there continues to be a need for a new and improved roof shake removal tool as set forth by the instant invention which addresses both the problems of ease of use as well as effectiveness in construction in the removal of roof shingles and shakes without damage to underlying felt and in this respect, the present invention substantially fulfills this need.

SUMMARY OF THE INVENTION

In view of the foregoing disadvantages inherent in the known types of shake removal tool apparatus now present in the prior art, the present invention provides a roof shake removal tool wherein the same is arranged to permit sliding of the tool underlying a shake to be removed permitting engagement with a nail or nails of the shake to be removed without damage to the underlying felt. As such, the general purpose of the present invention, which will be described subsequently in greater detail, is to provide a new and improved roof shake removal tool which has all the advantages of the prior art shake removal tool apparatus and none of the disadvantages.

To attain this, the present invention provides a generally "L" shaped leg plate orthogonally mounted to a second arcuate leg plate, wherein the first leg plate includes a first leg plate bifurcated free end defining a first leg plate notch, and wherein the second leg plate includes a convex leg plate surface oriented in confronting relationship relative to the first leg plate free end. The second leg plate includes a second leg plate free end formed with a first medial notch and respective second and third lateral notches positioned adjacent the free end relative to opposing first and second sides of the second plate to provide for multiple access to various nails and the like in removal of shingles and shakes without damage to underlying felt. A modification of the invention includes a support mount for the tool of the invention.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roof shake removal tool which has all the advantages of the prior art shake removal tool apparatus and none of the disadvantages.

It is another object of the present invention to provide a new and improved roof shake removal tool which may be easily and efficiently manufactured and marketed.

It is a further object of the present invention to provide a new and improved roof shake removal tool which is of a durable and reliable construction.

An even further object of the present invention is to provide a new and improved roof shake removal tool which is susceptible of a low cost of manufacture with regard to both materials and labor, and which accordingly is then susceptible of low prices of sale to the consuming public, thereby making such roof shake removal tools economically available to the buying public.

Still yet another object of the present invention is to provide a new and improved roof shake removal tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
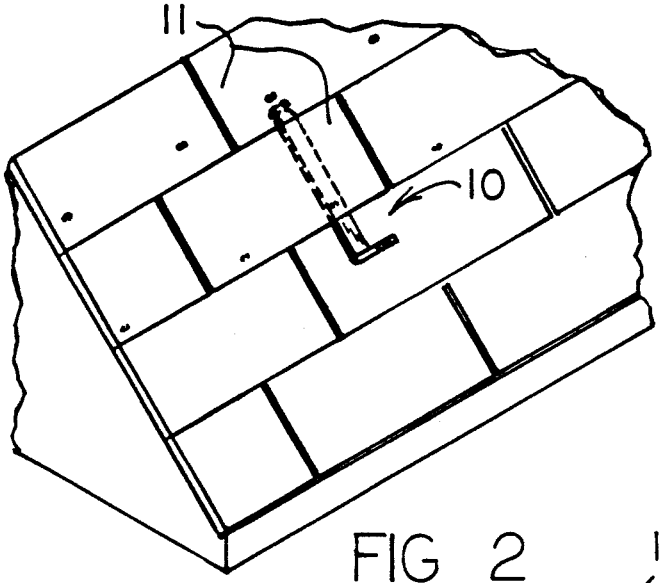
FIG. 2 is an isometric illustration of the invention in use.
Figure 1:
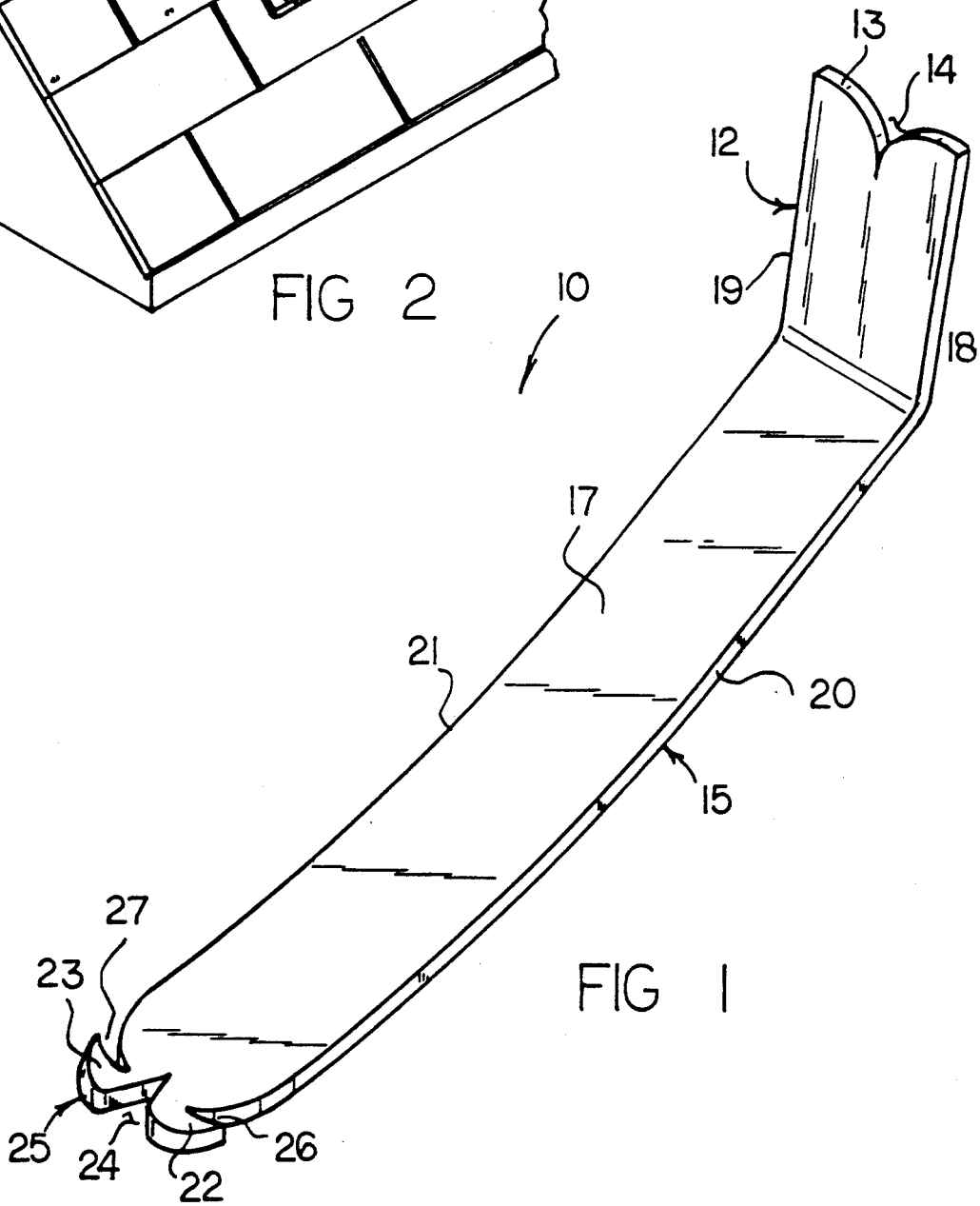
FIG. 1 is an isometric illustration of the instant invention.
Figure 3:
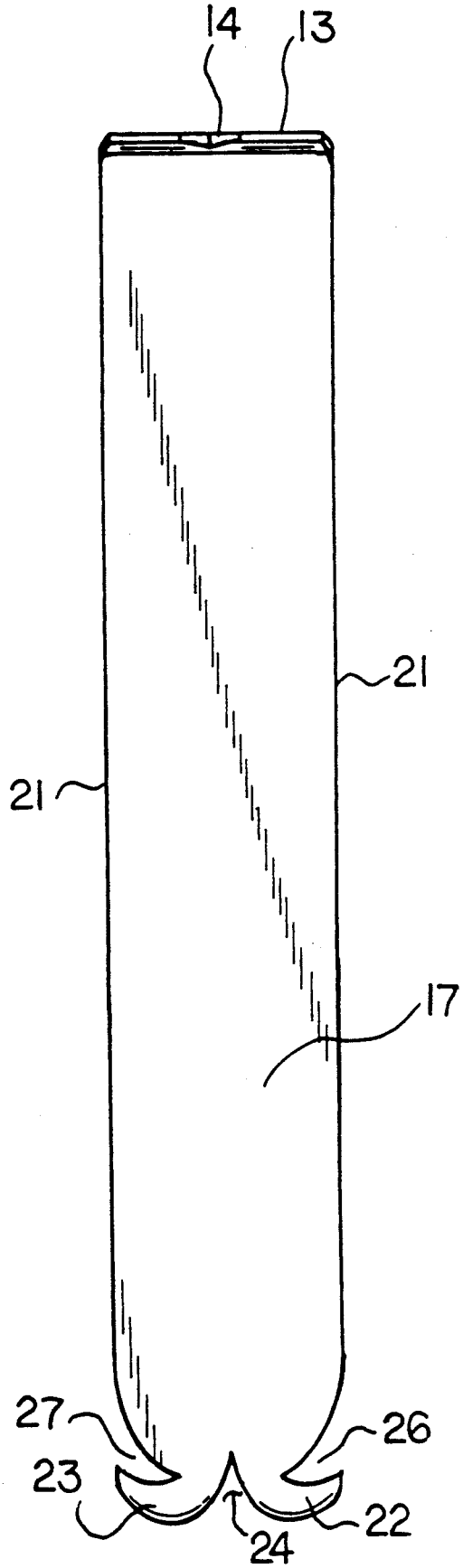
FIG. 3 is an orthographic top view of the instant invention.
Figure 4:
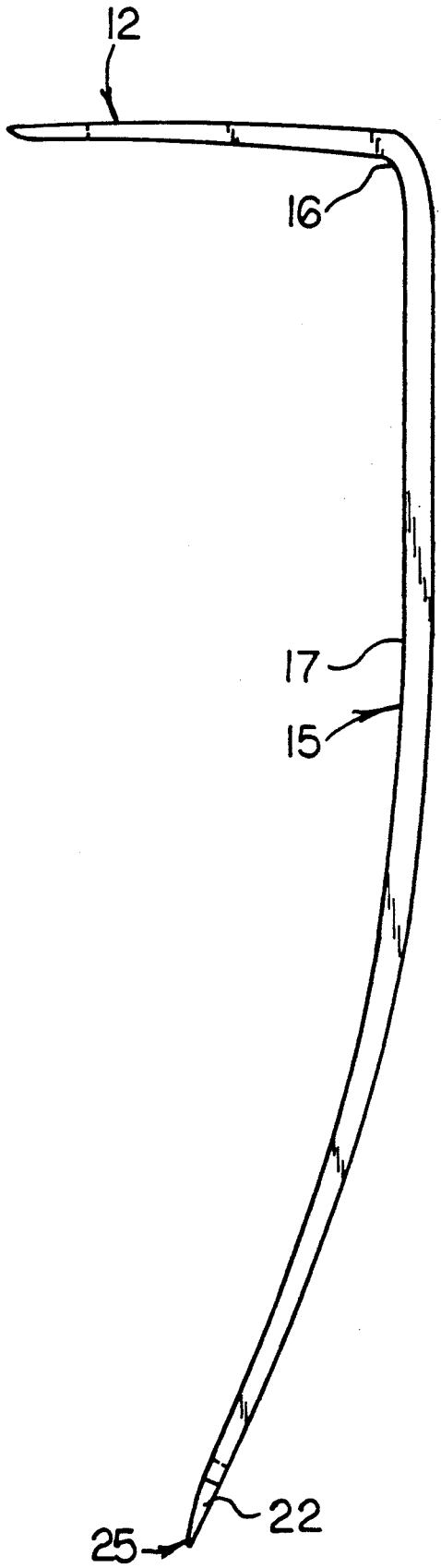
FIG. 4 is an orthographic side view of the instant invention.

With reference now to the drawings, and in particular to FIGS. 1 to 7 thereof, a new and improved roof shake removal tool embodying the principles and concepts of the present invention and generally designated by the reference numerals 10 and 10*a* will be described.

More specifically, the roof shake removal tool 10 of the instant invention essentially comprises the invention arranged for slidingly directed between adjacent offset roof shingles or shakes 11 to permit access to the nails therebetween permitting removal and leveraging of such nails relative to the associated roof plate minimizing and avoiding damage to underlying FLET typically positioned below the shingles in a coextensive relationship. The tool 10 includes a first planar leg plate 12 formed with a first leg plate bifurcated free end defining a first leg plate notch. A second arcuate leg plate 15 is joined to the first leg plate at a rigid intersecting connecting line 16 orthogonally orienting the second leg plate relative to the first leg plate, wherein the second leg plate 15 includes a concave top surface 17 that is arranged in a generally confronting relationship relative to the first leg plate free end 13 as the concave surface is gradually formed in a spaced relationship relative to the connecting line 16. The first leg plate includes a first leg plate first side 18 and a first leg plate second side 19 that are generally parallel relative to one another, wherein the second leg plate includes a second leg plate first side 20 and a second leg plate second side 21, as the first leg plate first side and the second leg plate first side are coplanar as are the first leg plate second side and the second leg plate second side. The second leg plate terminates in a second leg plate first arcuate leg 22 and a second leg plate second arcuate leg defining a second leg plate first notch 24 medially at a forward distal end of the second leg plate spaced remotely relative to the connecting line 16. The second leg plate first arcuate leg defines a second notch 26 between the second leg plate first arcuate leg 22 and the second leg plate first side. Similarly, the second leg plate second arcuate leg 23 defines a second leg plate third notch 27 between the second leg plate second arcuate leg 23 and the second leg plate second side 21 providing for ease of attachment and manipulation of a nail between any one of the notches of the second leg plate at its free distal end 25.

Figure 5:
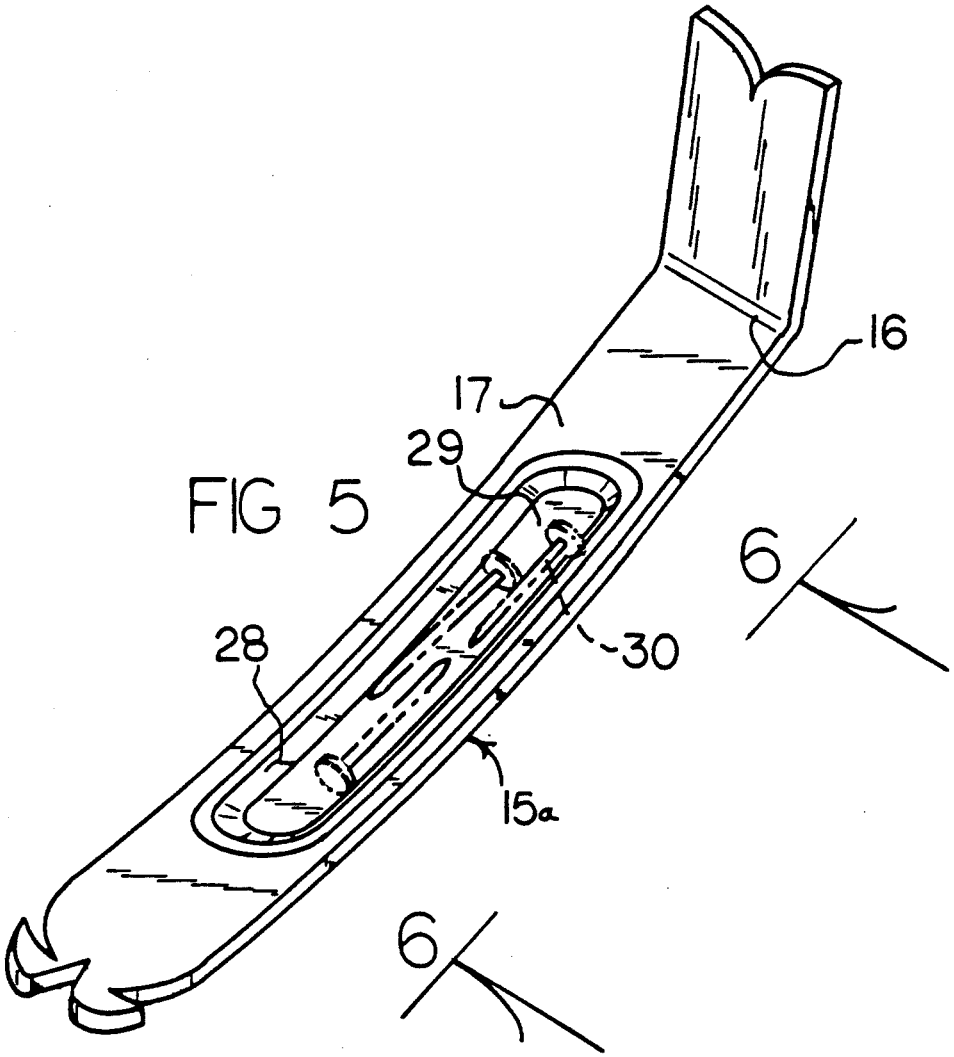
FIG. 5 is an isometric illustration of a modification of the invention.
Figure 6:
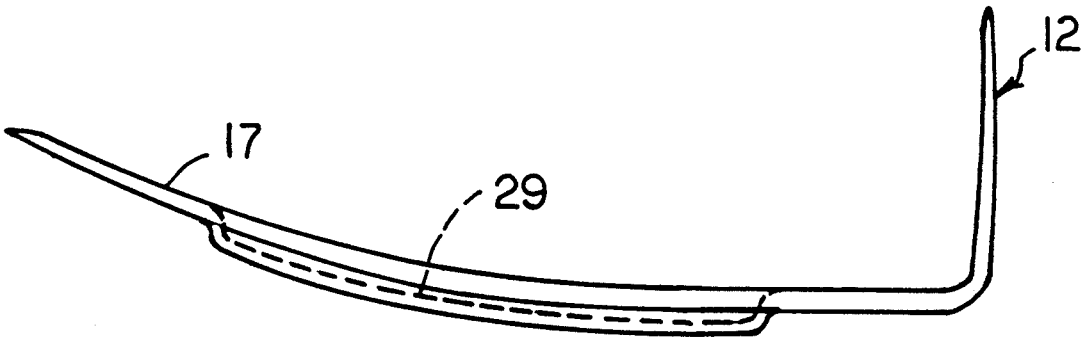
FIG. 6 is an orthographic side view, taken along the lines 6—6 of FIG. 5 in the direction indicated by the arrows.
Figure 7:
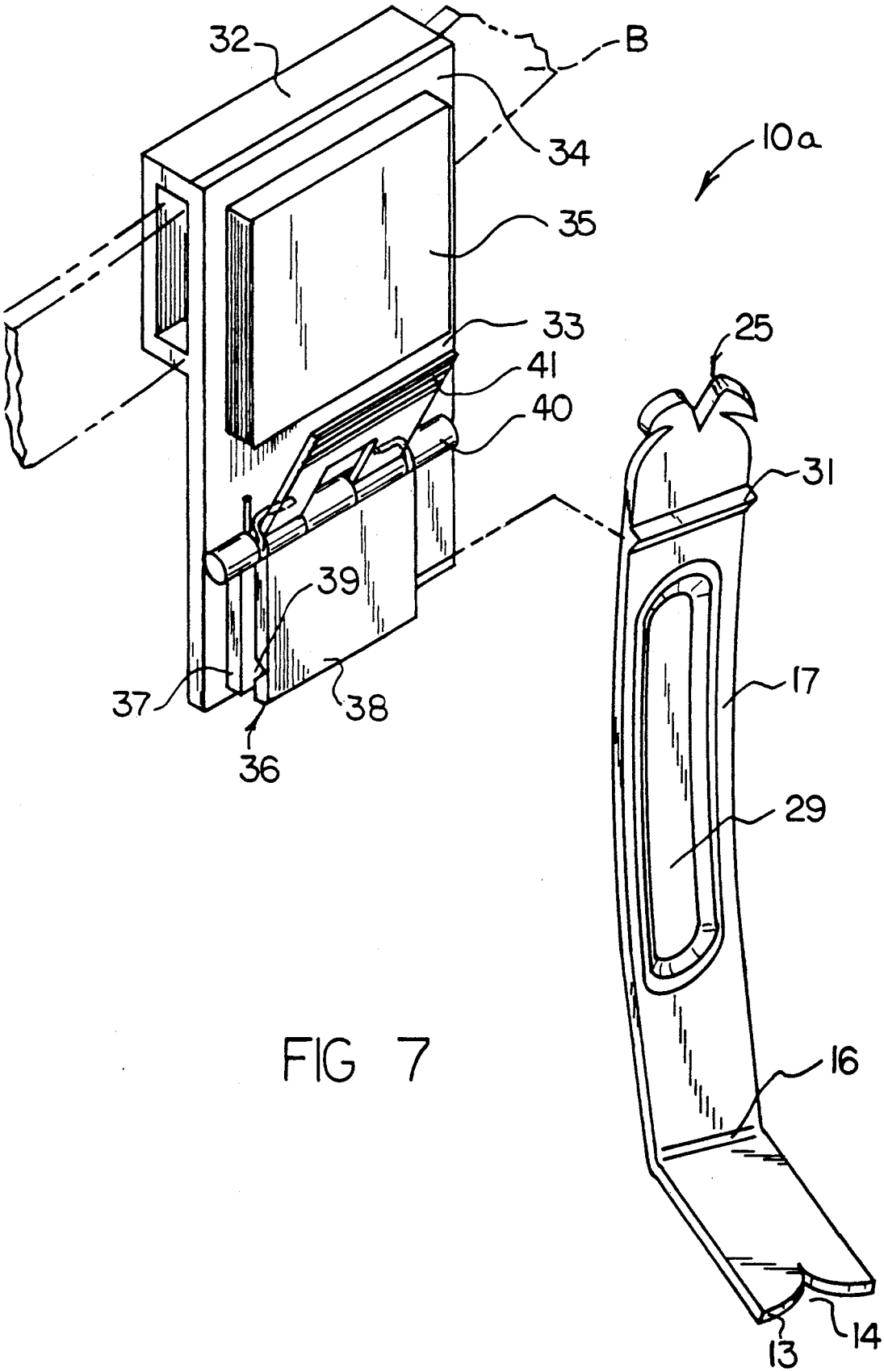
FIG. 7 is an isometric illustration of the modified invention and the associated support assembly.

Reference to FIGS. 5 and 6 illustrates the use of the second leg plate, including a second leg plate top surface cavity 28 defining a ferromagnetic floor 29 for the positioning of nail members 30 therewithin, wherein when such nail members are removed relative to a roof, they may be positioned within the pocket to prevent their accidental positioning about the roof surface for subsequent injury to an individual.

The modified apparatus 10*a* further includes (see FIG. 7) a rib 31 mounted to the second leg plate adjacent the second leg plate free distal end 25 as the rib 31 is arranged parallel relative to the intersecting connecting line 16. A belt receiving tube 32 to receive a belt "B" therethrough is provided with a tube front wall 34, including a tube front wall extension plate 33 extending downwardly in a coplanar relationship relative to the tube front wall 33 mounting a note pad 35 thereon for the ease of positioning of various accounting and material in use of the organization, as well as a spring clip 36. The spring clip 36 includes a first jaw 37 fixedly mounted to the tube front wall extension plate 33 and a second jaw 38 pivotally mounted relative to the first jaw about a spring hinge 40, wherein a second jaw extension flange 41 on an opposed side of the spring hinge 40 effects displacement of the second jaw relative to the first jaw upon depressing of the second jaw extension flange 41. A "V" shaped groove 39 formed within the second jaw in confronting relationship relative to the first jaw receives the rib 31 therewithin for the securement and grasping of the tool relative to the belt receiving tube front wall extension plate 33.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof shake removal tool, comprising, an "L" shaped rigid tool member, including a first planar leg plate orthogonally mounted to a second arcuate leg plate at a connecting line, and the first planar leg plate includes a bifurcated free end defining a first leg plate notch spaced remotely relative to the connecting line, and the second arcuate leg plate defines a concave top surface arranged in confrontation relative to the first leg plate bifurcated free end, and wherein the second leg plate includes a second leg plate free end, and the second leg plate free end includes a first arcuate leg splayed relative to a second arcuate leg defining a second leg plate first notch therebetween, and the first leg plate includes a first leg plate first side spaced from and parallel a first plate second side, and the second leg plate includes a second leg plate first side spaced from and parallel a second leg plate second side, wherein the first leg plate first side and the second leg plate first side are coplanar, and the first leg plate second side and the second leg plate second side are coplanar, and the second leg plate first arcuate leg defines a second leg plate second notch between the second leg plate first arcuate leg and the second leg plate first side, and a third notch is defined between the second leg plate second arcuate leg and the second leg plate second side, and the second leg plate includes a second plate top surface cavity formed within the second leg plate protruding downwardly relative to the concave top surface, and the second leg plate top surface cavity includes a ferromagnetic floor for attraction of ferromagnetic components thereon.

* * * * *